US007334509B1

(12) United States Patent
Gao

(10) Patent No.: US 7,334,509 B1
(45) Date of Patent: Feb. 26, 2008

(54) TORQUE LIMITING DRIVER AND ASSEMBLY

(75) Inventor: Hua Gao, Fox Point, WI (US)

(73) Assignee: Bradshaw Medical, Inc., Kenosha, WI (US)

( * ) Notice: Subject to any disclaimer, the term of this patent is extended or adjusted under 35 U.S.C. 154(b) by 0 days.

(21) Appl. No.: 11/545,916

(22) Filed: Oct. 11, 2006

(51) Int. Cl.
*B25B 23/157* (2006.01)

(52) U.S. Cl. ..... 81/475; 81/52; 81/467; 81/473

(58) Field of Classification Search ..... 81/52, 81/467, 473, 475
See application file for complete search history.

(56) References Cited

U.S. PATENT DOCUMENTS

| | | | | |
|---|---|---|---|---|
| 1,566,553 | A | 12/1925 | Maisch | |
| 1,860,871 | A | 5/1932 | Pouliot | |
| 2,332,971 | A | 10/1943 | Johnson | |
| 2,802,354 | A | 8/1957 | Bohnhoff et al. | |
| 3,168,944 | A | 2/1965 | Livermont | |
| 3,277,670 | A | 10/1966 | Bent | |
| 3,277,671 | A | 10/1966 | Winstone et al. | |
| 3,305,058 | A | 2/1967 | Orwin et al. | |
| 3,613,751 | A * | 10/1971 | Juhasz | 81/474 |
| 3,653,226 | A | 4/1972 | Westbury | |
| 3,702,546 | A | 11/1972 | Schnepel | |
| 3,942,337 | A | 3/1976 | Leonard et al. | |
| 4,041,729 | A | 8/1977 | Bilz | |
| 4,668,206 | A | 5/1987 | Fukumoto | |
| 4,712,456 | A | 12/1987 | Yuan | |
| 5,035,311 | A | 7/1991 | Girguis | |
| 5,054,588 | A | 10/1991 | Thorp et al. | |
| 5,156,244 | A | 10/1992 | Pyles et al. | |
| 5,356,350 | A | 10/1994 | Schreiber | |
| 5,383,818 | A | 1/1995 | Lessat-Kaupat et al. | |
| 5,505,676 | A | 4/1996 | Bookshar | |
| 6,132,435 | A | 10/2000 | Young | |
| 6,257,351 | B1 * | 7/2001 | Ark et al. | 173/178 |
| 6,640,674 | B1 | 11/2003 | Rinner et al. | |
| 6,990,877 | B1 | 1/2006 | Wu | |

* cited by examiner

*Primary Examiner*—Joseph J. Hail, III
*Assistant Examiner*—Shantese L. McDonald
(74) *Attorney, Agent, or Firm*—Ryan Kromholz & Manion, S.C.

(57) ABSTRACT

A method for assembling a torque-limiting driver, and the resulting drive. The method comprises the steps of providing a handle having a housing, drive assembly, and a testing assembly. The drive assembly is assembled, inserted into the testing assembly and calibrated. The drive assembly is then removed and inserted into the housing of the handle and secured to the handle.

18 Claims, 4 Drawing Sheets

TORQUE LIMITING DRIVER AND ASSEMBLY

BACKGROUND OF THE INVENTION

The present invention relates to mechanical drive devices for tools and the like, and, more specifically, to drive devices that will limit the torque being delivered by the device to an attached tool member.

Many mechanical devices are used to deliver a large amount of torque to a screw, bolt, nut, or other similar device or object. Even though there is a large amount of torque being delivered, in many situations, it is still desirous to control the precise amount of torque being delivered. For instance, too much torque may strip the object that is being driven, which would lead to the driven object becoming ineffective, such as a stripped bolt or screw. This is especially important in medical operations and procedures, where precision is critical, such as when working with spinal and skeletal structures and related devices. Thus, drivers have been developed to limit the amount of torque delivered to the driven object or device.

Because these devices are designed for precise and accurate movement, care must be maintained when assembling the driver devices. That is, the individual parts of driver must be precisely joined together. If the parts are not assembled properly, the arrangement of the driver may not deliver a proper amount of torque, which diminishes the usefulness of the driver.

Furthermore, it would be advantageous to provide a driver assembly that would allow precision testing of the driver assembly before final assembly of the driver tool. With prior art tools, a driver assembly is inserted into a handle of a driver tool, and then the precision and accuracy of the tool is adjusted. This can be time consuming, specifically when assembling a large number of tools at one time. If the driver assembly could be assembled and calibrated separately before being inserted into the handle of a driver tool, it would improve the assembly process and, also, provide a more consistently calibrated driver compared to the prior art.

SUMMARY OF THE INVENTION

The present invention provides a new and novel toque-limiting driver, and a method for assembling the driver. The driver generally comprises a handle that forms a housing having an open and closed end, and a drive assembly. The drive assembly comprises a drive shaft that supports a drive clutch member and a camming clutch member that engage with one another to provide the torque-limiting action of the driver. The clutch members are biased against one another, and are secured on the drive shaft with a locking screw or other similar device.

When the drive assembly is inserted into the housing, the locking screw is located near the closed end of the housing, which gives added support and stability for the locking screw compared to prior art arrangements.

The present invention also encompasses a method for making the above driver. A testing assembly is provided that will receive the drive assembly of the driver, with all of the various components of the drive assembly secured on the drive shaft. Once inserted into the testing assembly, the drive assembly can be properly and accurately calibrated. The drive assembly will be inserted into the housing and secured to the housing. The method allows for a more efficient and easy way of calibrating the drive mechanics compared to the prior art, which results in a more efficient driver.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

Figure 1:
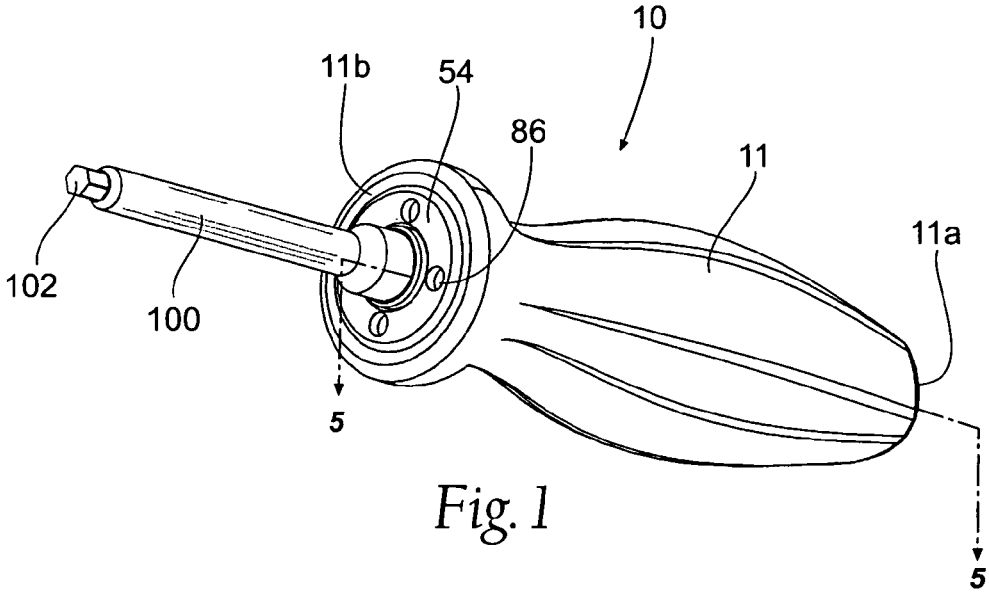
FIG. 1 is a perspective view of an assembled torque limited driver in accordance with the present invention.

FIG. 1 is a perspective view of a torque-limiting driver 10 assembled according to the present invention. The driver 10 comprises a handle 11 having a first end 11*a* and a second end 11*b*. The handle 11 is coupled to a tool 100 at the second end 11*b*, with the tool 100 having an area 102 for engaging a device for which the driver 10 will provide torque or driving force. The area 102 is shown to be a hex wrench, but could be a screwdriver, wrench, or any other tool arrangement. A threaded locking screw 54 secures the tool 100 to the handle 11.

Figure 2:
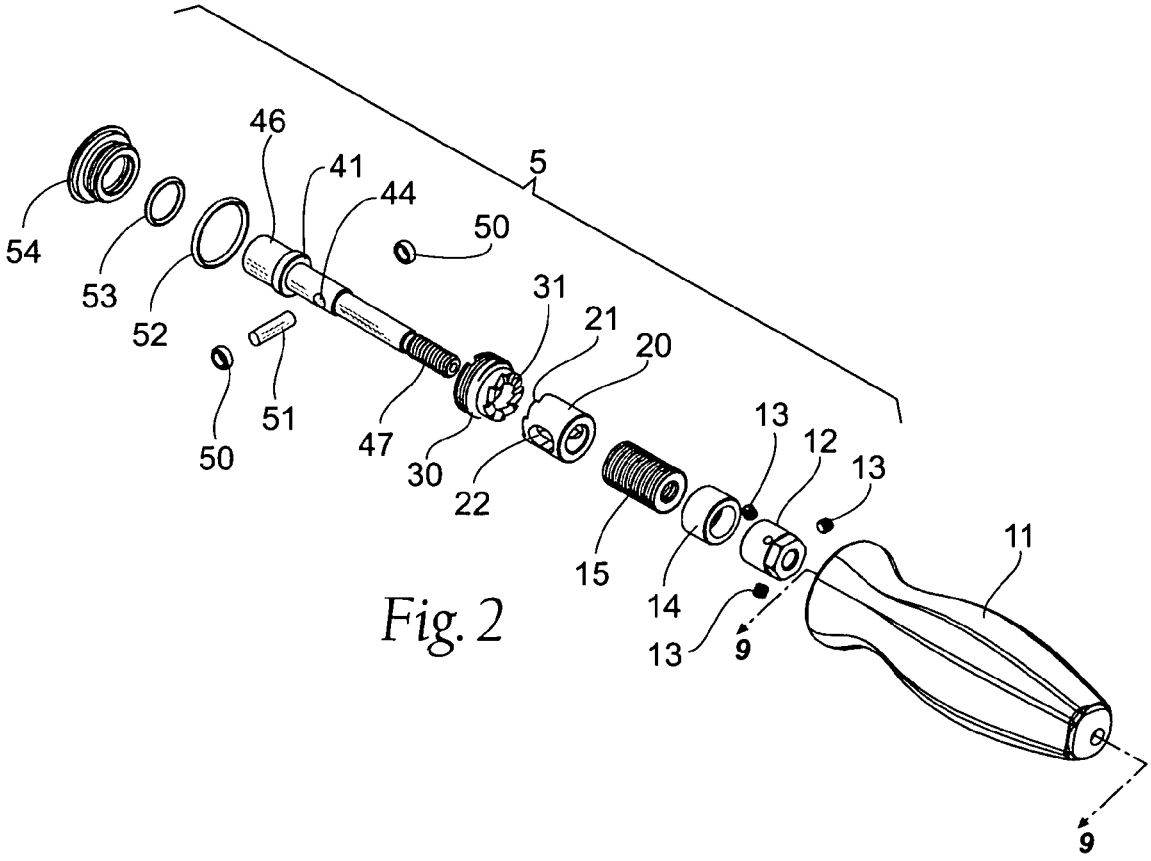
FIG. 2 is an exploded view of the driver of FIG. 1.

FIG. 2 provides an exploded view of the handle 11, which houses a driver assembly 5. The driver assembly 5 comprises a locking screw 12 that is adjustable so as to provide the proper tension and calibration for the assembly 5 and the driver 10, in general. A plurality of set screws 13 secures the locking screw 12 in proper alignment within the assembly 5. The locking screw 12 sits upon a threaded section 47 of a drive shaft 41. The drive shaft 41 further supports a spacer 14, which is located between the locking screw 12 and a spring 15. The arrangement of the spring 15 and the locking screw 12 contribute to proper tensioning and biasing means for the assembly 5. The drive shaft also supports a pair of cam members 20, 30, which will be discussed in more detail with respect to FIGS. 6-8. The cam members 20, 30 are arranged for interaction and to provide the main driving section for the assembly 5 and, also, to provide the proper torque and torque-limiting arrangement for the assembly 5. A slot 22 located on the cam member 20 and an opening 44 located on the drive shaft 41 receive a pin 51, which connects the shaft 41 and the cam member 20 together. The pin 51 supports a pair of wheels 50, which will be discussed further with respect to FIGS. 3 and 4. As previously stated, the threaded end screw 54 secures and locks the various elements of the assembly 5 within the handle 11. An O-ring 53 provides sealing means for the end screw 54 and the handle, and a second O-ring 52 provides sealing means between the drive shaft 41 and the end screw 54.

Figure 3:
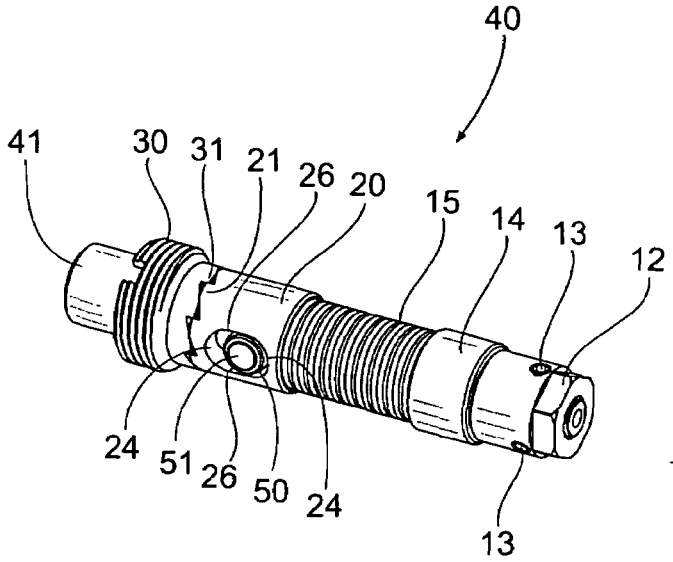
FIG. 3 is a perspective view of a drive assembly used in accordance with present invention.
Figure 4:
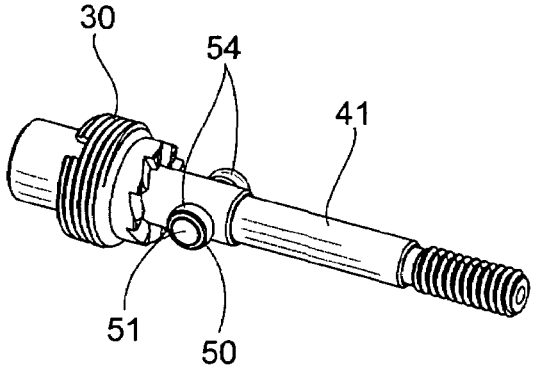
FIG. 4 is a perspective view of the drive assembly of FIG. 3 having a cam member removed.

FIGS. 3 and 4 provide perspective views of a driver assembly 40, with the shaft 41 providing the main section for the driver assembly 40. FIG. 3 shows the drive shaft 41 supporting the cam members 20 and 30, the spring 15, the spacer 14, and the locking screw 12. The cam member 30 will be referred to as driving cam 30 for the present invention, while the cam member 20 will be referred to as the clutch cam 20. The driving cam 30 has a toothed or serrated surface 31 that interacts with a toothed or serrated surface 21 located on the clutch cam 20. It should be understood that other common torque-limiting or ratcheting drive systems could be used in the present invention. For example, a drive system using balls or bearings between the two clutch plates could also be used and still fall within the scope of the present invention. The locking screw 12 holds the spring 15 and the spacer 14, thereby providing the necessary biasing means for the cams 20, 30 and their respective interacting toothed surfaces 21, 31 when tension is exerted on the cams 20, 30.

FIG. 3 further shows the slot 22 on the clutch cam 20 housing the wheel 50. The clutch cam 20 has a second slot 22 (not shown) oppositely disposed of the first slot 22, which houses the second wheel 50 (see FIG. 2). As is understood, reference to a single wheel 50 or slot 22 refers to either or both wheels or slots, unless otherwise specified. The arched surface 54 of the wheels 50 (FIG. 4) are in a tangential relationship with opposing sides 24 of the slot 22 (see FIG. 8) and also the elongated sides 26, regardless of whether the pin 51 may rotate or not, or even if the angle of the pin 51 may change. This is an important feature of the invention in that the arrangement prevents unnecessary wear on the wheels 50 against the slot 22, as the outward force is generally constant in all outward directions. The elongated sides 26 allow for movement of the cam member 20 relative to the cam member 30 when the driver assembly 40 is in use. The arched surface 54 also assists in keeping the proper tension needed for consistent torque delivery by the assembly 5. When the driver 5 is in use, force will be delivered in two directions, twisting force of the individual cam members 20, 30 working against each other, and the backwards force opposite the axial driving force of the assembly 5. As such, the wheel 50 acts as a bearing in response to these forces. Prior art arrangements used hexagonal nuts in place of the wheels 50 of the present invention. However, such nuts are not the most efficient in counteracting the backwards force delivered by a driver assembly, as they do not evenly disperse the force within the housing. This leads to unnecessary wear on the nuts and, consequently, diminishes the usefulness of a driver assembly. As the nuts wear down, the precision of the interaction of the cam members 20, 30 will be diminished, as the specific plates will have more play than needed when interacting. The arched surface 54 of the wheel 50 provides an even bearing surface against the slot 22, and thereby minimizes any deleterious effects associated with the force delivered by the driver 10.

FIG. 4 shows the drive assembly 40 without the clutch cam 20 located on the drive shaft 41. As previously stated, the curved surfaces 54 of the wheels 50 reduce wear and stress when moving within the slots 22, as compared to prior art devices. Further in FIG. 4, the driving cam 30 is shown supported by the drive shaft 41. The drive shaft 41 has an enlarged end 46 (see FIG. 2) so that the driving cam 30 may be fittingly situated over the enlarge end 46. Once the other elements described and shown in FIG. 3 are situated on the shaft 41, the driving cam 30 will be securely held in place on the shaft 41 without the need for additional fastener devices.

Figure 5:
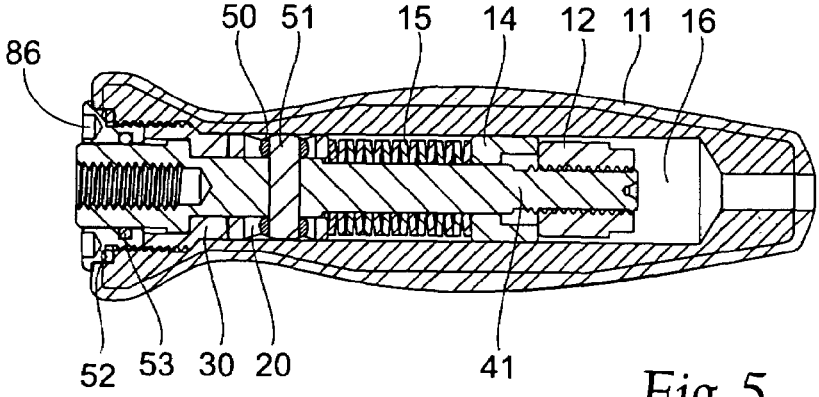
FIG. 5 is a cross-sectional view of the driver of FIG. 1 taken along ling 5-5 of FIG. 1.
Figure 13:
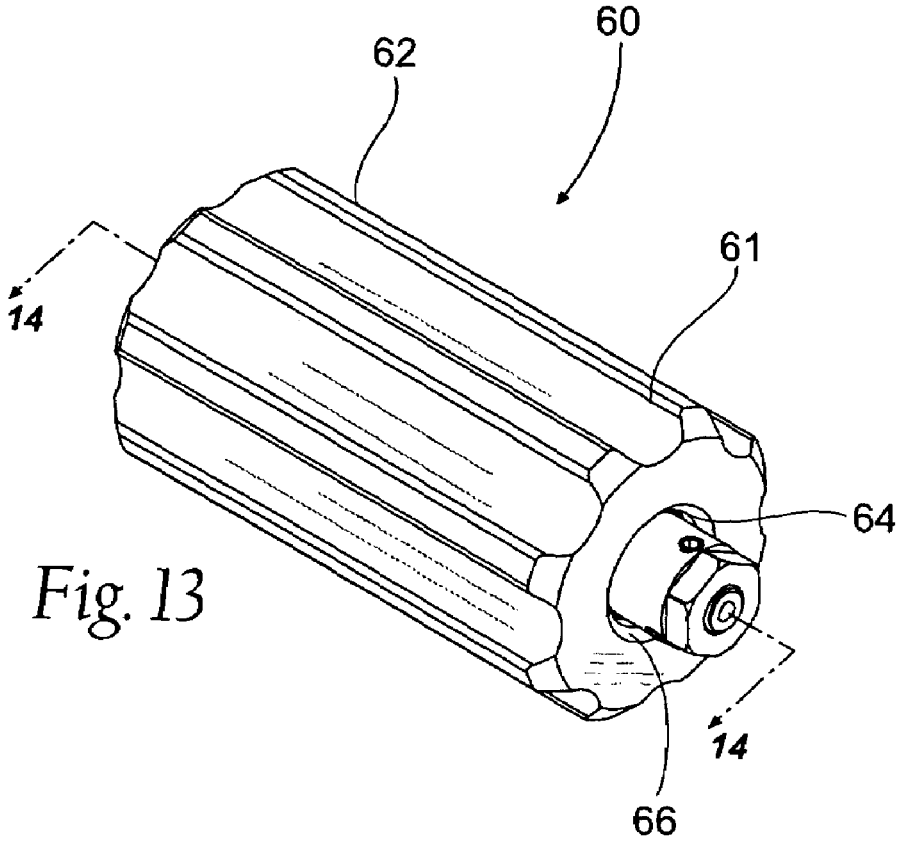
FIG. 13 is a perspective view of an assembly tool used in accordance with the present invention.
Figure 14:
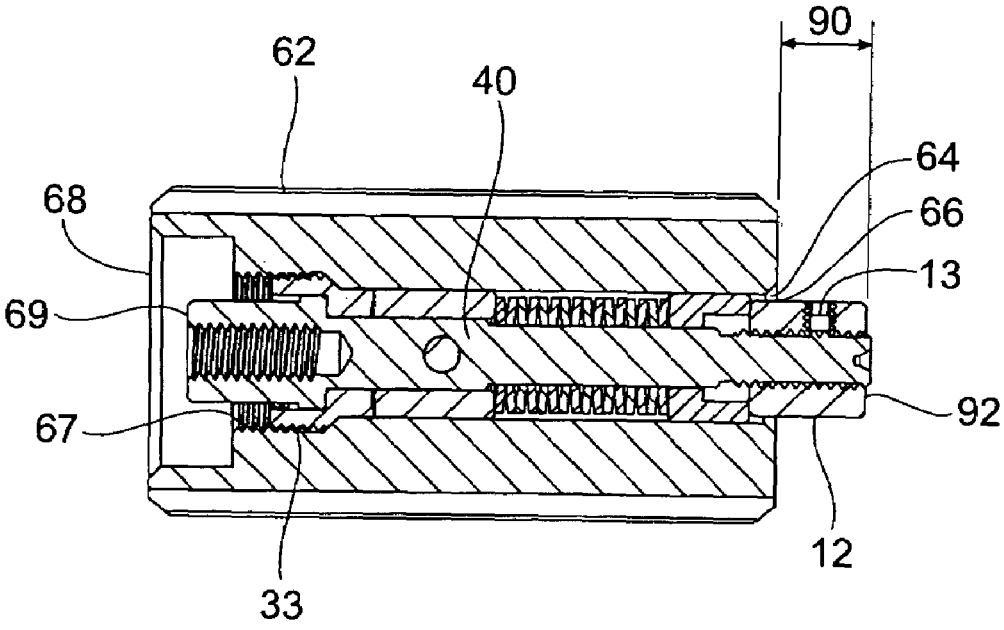
FIG. 14 is a cross-sectional view of the assembly tool of FIG. 13 taken along the line 14-14 of FIG. 13.

FIG. 5 shows a cross-sectional view of the handle 11, with the drive assembly 5 secured within the handle 11. As discussed previously, the driver assembly 5 is inserted into the housing 16 of the handle 11 with the locking screw 12 being inserted first into the housing 16 and located proximal to the first end 11*a* of the handle 11. This is a unique arrangement compared to the prior art, which required the locking screw 12 to be essentially the last item of a drive assembly to be inserted into a housing so that precision of an individual assembly could be tested before final overall assembly of a tool. The present arrangement allows for the assembly 5 to be preassembled and properly calibrated and stored before being inserted into the handle 11, which simplifies production of the handle 11. Also, because the locking screw 12 is configured near the closed end 11*a* of the handle 11 and the housing, there is less possibility compared to the prior art for the locking screw 12 to loosen over time. Since the housing 16 provides resistance against the locking screw 12, the locking screw 12 will be more easily retained than in previous arrangements. Further, because the locking screw 12 is separated from where the assembly 5 is attached to the handle 11, any competing forces from the handle delivering torque to the assembly 5 will not be transferred to the locking screw 12. Thus, reduced precision of the overall unit is minimized. This allows the present driver 10 to maintain proper and consistent tension for a longer time compared to the prior art, thereby providing a more useful tool that requires less possible maintenance and recalibration compared to the prior art. FIGS. 13 and 14 will further describe and show the features that provide the advantages of this assembly method.

Figure 6:
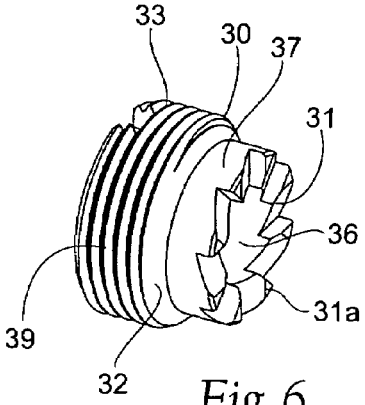
FIG. 6 is a front perspective view of a cam member used in the present invention.
Figure 7:
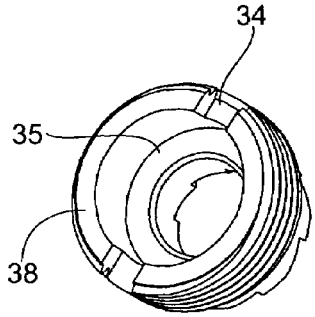
FIG. 7 is a rear perspective view of the cam member of FIG. 6.

FIGS. 6 and 7 provide perspective views of the driving cam 30. The driving cam 30 has a first section 37 having a serrated surface 31 that interacts with a serrated surface 21 (see FIG. 8) of the clutch cam 20. The inner diameter 36 of the first section 37 is designed to be fittingly slid onto the shaft 41 (see FIGS. 2 and 3). The serrated surface 31 provides a clockwise gear path. The first section 37 extends downwardly and meets a second section 39, which has a second end 38 (FIG. 6) oppositely disposed of the serrated surface 31. The second section 39 has an outside threaded surface 33, which is a right-handed threaded surface 33. The combination of the right-handed threaded surface 33 with the clockwise gear path is an important feature of the present invention in that it allows a unique design that provides increased precision within the drive assembly 5. The combination of the right-handed threaded surface 33 and the clockwise gear driving cam 30 to be directly mounted on the handle 11 by way of the right-handed thread path (see FIG. 5). Because the driving cam 30 is fixed onto the handle 11, it does not move as a drive unit, as in the prior art. Prior art drivers are movably connected to the handle of the driver, which adds unnecessary friction and wear onto the driver. The present invention allows for an independent torque drive mechanism, and the pushing force exerted by the user onto the handle 11 will not add undue strain to the spring 15, thereby allowing a more accurate and precise torque delivery. That is, the precision of the torque delivered by the driver 10 is independent of the amount of force used by the person and independent of the force delivered to the biasing means or spring 15 by the interacting cam members 20, 30. Thus, the precision of the torque-limiting arrangement of the cam members 20, will not be affected by the amount of the torque delivered by the user to the driver 10, which is important in delicate situations such as surgical procedures. Because prior art drivers could vary widely by the amount of force delivered by the user, there was not the consistent torque delivery, as found in the present invention. Thus, the driver 10 will be able to deliver the necessary, required amount of torque for a particular procedure, regardless of the force delivered by the user. This is particularly advantageous for use during critical situations, such as during a skeletal surgical procedure.

The arrangement prevents the assembly 5 from loosening after being used over time, since the forces of the surface 33 and the gear path work are designed to keep the proper resistance for the overall assembly 5. Prior art assemblies have serrated surfaces with the teeth arranged in the opposite direction as that of the present invention, which, over time, could potentially loosen and reduces the utility of the assembly. Likewise, the present arrangement was not contemplated with the prior art since it was realistically feasible without the production method used in the present invention.

Still referring to FIGS. 6 and 7, the first section 37 and the second section 39 are preferably joined so that the chamfered face 32 of the second section 39 that meets the first section 37 is angled at a 45' with respect to the central longitudinal axis X of the cam member 30. This allows for proper threading and alignment of the assembly, as will be discussed further with respect to FIG. 9. This arrangement will also assist in insuring that the assembly 5 is properly aligned within the handle 11. As previously noted, the cam member 30 is seated upon the shaft 41, with the interior face 35 fitting over and resting upon the enlarged end 46, as shown in FIGS. 3 and 4. The arrangement of the face 35 and the enlarged end 46 allows the cam member 30 to be movingly secured upon the shaft 41, without the need for other fasteners or attachment means. The second end 38 of the cam member 30 has a pair of opposing slots 34 that are designed for assembly purposes. The tip of a tool used to assembly the driver 10, such as a wrench will be inserted into the slots 34 to tighten or loosed the drive assembly 40.

Figure 8:
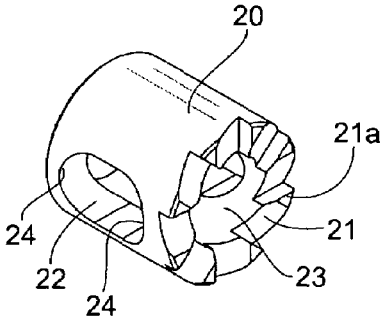
FIG. 8 is a perspective view of a second cam member used in the present invention.

FIG. 8 provides a perspective view of the clutch cam member 20. As noted, the serrated surface 21 of the cam member 20 interacts with the serrated surface 31 of the cam member 30 (see FIG. 3). As stated above, it should be understood that other cam arrangements, such as two-directional driver arrangements, could be incorporated into the invention. When the driver 10 is used to drive a device, the serrated teeth 21 and 31 will slide against one another, until reaching a maximum point or points 21*a*, 31*a*, respectively, of the serrated surfaces 21 and 31, which corresponds to the maximum torque that is delivered by the driver 10. The inner diameter 23 of the cam member 20 is substantially the same diameter as that of the inner diameter 36 of the cam member 30 (FIG. 6), thereby allowing proper alignment and mating upon the shaft 41 (see FIG. 2). FIG. 8 also shows the slot 22. As discussed in FIGS. 3 and 4, the slot 22 is designed to minimize stress on the wheels 50. The slots 22 are slightly elongated to allow for axial movement of the wheels 50 when the assembly 5 is in use and the cam members 20, 30 move relative to one another.

Figure 9:
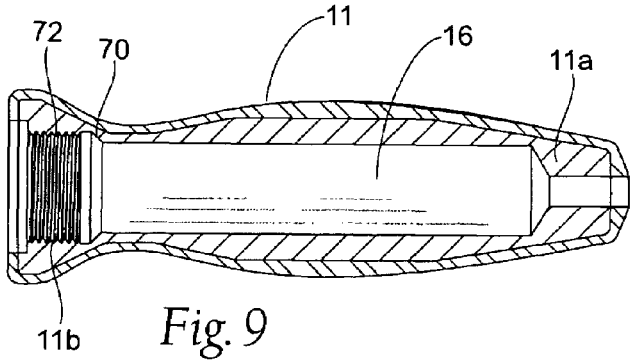
FIG. 9 is a cross-sectional view of a handle used in the present invention taken along the line 9-9 of FIG. 2.

FIG. 9 shows a cross-sectional view of the handle 11. The handle 11 forms the housing 16 for the assembly 5. The second end 11*b* of the handle has a threaded area 72, which is preferably a right-handed threaded area to properly engage the threaded surface 33 (see FIG. 6) of the cam member 30. The housing 16 at the second end 11*b* also has a slanted or chamfered face 70 that preferably has a 45° with respect to the central elongated axis of the handle 11. The chamfered face 70 coincides with the preferred 45° of the chamfered face 32 of the cam member 30. While it is not necessary that the chamfered face 70 and the chamfered face 32 form 45°, it is preferably, and also preferable that they form complimentary angles, thereby providing a solid mating structure. The face 70 provides a surface for the cam member 30 to abut, thereby allowing the handle 11 to generate the proper driving force from the handle 11 for the shaft 41 and the torque unit 40 and the assembly 5, in general.

Figure 10:
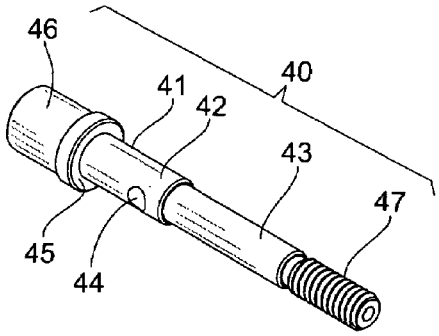
FIG. 10 is a perspective view of a drive shaft used in accordance with present invention.

FIG. 10 shows a perspective view of the shaft 41 of the torque unit 40. As stated with respect to FIG. 2, the torque unit 40 comprises the shaft 41 having a first outer diameter 42 for receiving the cam members 20, 30 and a second outer diameter 43 that supports the spring 15 and the spacer 14 (see FIG. 3). The threaded section 47 of the torque unit 40 allows the locking screw 12 to secure the various recited elements onto the shaft 41. The shaft 41 has a top face 45 located on the enlarged end 46 of the shaft 41, with the top face 45 engaging the inner face 35 of the drive cam 30.

Figure 11:
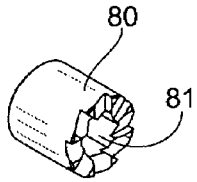
FIG. 11 is a perspective view of an alternate cam member used in accordance with the present invention.
Figure 12:
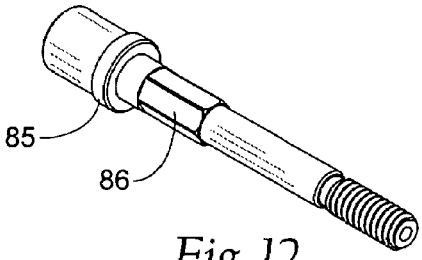
FIG. 12 is a perspective view of an alternate drive shaft used with the cam member of FIG. 11 according to the present invention.

FIGS. 11 and 12 provide an alternate embodiment for a clutch cam member and supporting shaft. FIG. 11 shows an alternate cam member 80 that could be used in place of the cam member 20. The cam member 80 is designed similarly to the cam member 20, with the exception that the inner diameter 81 of the cam member 80 has a hexagonal shape, which will mate with a hexagonal surface 86 located on a shaft 85, shown in FIG. 12. The hexagonal arrangement and interaction provides the necessary locking and bearing mechanism previously associated with the slots 22 and the wheels 50 used with the cam member 20. The cam member 80 will interact with the cam member 30 in the same fashion as was previously discussed with respect to the interactions of the cam member 20 and 30. While it is preferable that the inner diameter 81 is of a hexagonal fashion, it is understood that any polygonal shape could be used, provided that the same mating polygonal shape was used on the shaft 86 for a proper mating arrangement.

FIGS. 13 and 14 display the components used to properly setup and calibrate the assembly 5 before insertion of the assembly into the handle 11 and complete assembly of the driver 10. A testing assembly 60 comprises a torque testing handle 61 having an outer gripping surface 62 and an inner surface 64. The inner surface 64 is arranged and dimensioned to fittingly receive the torque unit 40, with the torque unit 40 being inserted through an open end 66. The shaft 41 of the torque unit is secured to a threaded section 67 of the testing assembly 60 that is located at a closed end 68 of the testing assembly 60. The threaded surface 33 of the cam member 30 is threaded onto the threaded section 67, holding the shaft 41 within the assembly 60. The closed end 68 provides a stop 69, which is dimensioned to receive the shaft 41.

Once the shaft 41, along with all of the various elements of the torque unit 40 described in FIGS. 3 and 4, is inserted into the assembly and secured to the threaded section 67, the locking screw 12 and the set screws 13 can be properly adjusted. When the unit 40 is inserted into the assembly 60, there will be a free space 90 located between the open end 66 and the far end 92 of the locking screw. The free space 90 allows the adjustment of the screw 12 and the set screws 13. Once the screws 12, 13 are properly calibrated, the entire torque unit 40 is removed from the assembly 60 (FIG. 3) and then inserted into the handle 11 (FIG. 9). The procedure shown and described is unique compared to the prior art in that the setup, calibration, and assembly of the torque unit 40 is done independently before insertion into the handle 11.

Prior art systems required the various components of a drive assembly to be inserted into a handle and then calibration was performed, which did not necessarily allow presetting of the components. This had the potential of having improperly or insufficiently calibrated or aligned tools, which affects the usefulness of the tools. Similarly, calibration between drivers may vary more than in the present invention, since several of the driver assemblies of the present invention can be assembled and calibrated at one time without needing to completely assemble the driver.

Furthermore, the present arrangement, as discussed with respect to FIG. 5, allows the locking screw 12 to be inserted first into the closed end 11*b* of the handle 11 before the other components of the drive assembly 5. This provides added support and resistance for the assembly 5 overall by minimizing forces that would loosen the screw 12 or the screws 13. Because prior art systems did not contemplate a device such as the testing assembly 60 for preassembly of the torque unit 40, the screws 12 and 13 would have to be arranged at the open end 11*a* of the handle 11 and would not have the added support of the closed end 11*b* as in the present arrangement.

As mentioned, the torque unit 40 of the present invention can be assembled separately from the handle 11. The individual torque units 40 can be preassembled and stored and then inserted in a handle at a later time. This can save time in that several torque units 40 can be assembled at one time, and will already be calibrated when they are too be inserted into a handle at a later time.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

I claim:

1. A torque-limiting driver comprising:

a handle comprising a housing having an enclosed end and an open end;

a drive assembly located within said housing, said drive assembly comprising;

a drive shaft;

a drive clutch member supported by said drive shaft, said drive clutch member having an engageable surface;

a camming clutch member supported by said drive shaft, said camming clutch having an engageable surface arranged to interact with the engageable surface of said drive clutch member;

means for coupling said second camming clutch member and said drive shaft;

means for biasing said first drive clutch member and said second camming clutch member towards one another;

locking means supported by said drive shaft, said locking means located at said enclosed end of said housing;

means for securing said drive assembly within said housing; and wherein said drive clutch member comprises an outer chamfered surface, said outer chamfered surface abutting an internal chamfered surface of said housing, thereby providing means for delivering torque from said handle to said drive assembly, said torque delivery means being independent from said biasing means.

2. The driver according to claim 1 wherein said means for coupling said drive shaft to said second camming clutch member further comprises:

a pin intersecting said drive shaft and said second camming clutch member; and a pair of wheel members located on opposing sides of said pin, said wheel members further securing said pin to said drive shaft and said second camming clutch member.

3. The driver according to claim 2 wherein said wheels are located within a respective slot located in said opposing sides of said camming clutch member, said wheel members providing bearing means for said camming clutch member.

4. The driver according to claim 1 wherein said outer chamfered surface being angled at 45° with respect to a central axis of said housing, said internal chamfered surface being at a complimentary angle to said outer chamfered surface.

5. The driver according to claim 1 wherein said engageable surface of said camming clutch member and said engageable surface of said drive clutch member comprise a serrated surface.

6. The driver according to claim 5 where said serrated surface of said drive clutch member comprises a clock-wise facing serrated surface.

7. A torque-limiting driver comprising:

a handle comprising a housing having a first enclosed end and a second open end;

a preassembled drive assembly located within said housing, said drive assembly comprising;

a drive shaft;

a drive clutch member supported by said drive shaft, said drive clutch member having an engageable surface;

a camming clutch member supported by said drive shaft, said camming clutch having an engageable surface arranged to interact with the serrated surface of said first drive clutch member;

means for biasing said first drive clutch member and said second camming clutch member towards one another;

locking means for securing said drive assembly components in an operating fashion, said locking means supported by said drive shaft, said locking means located at said first enclosed end of said housing;

means for securing said drive assembly within said housing, and wherein a portion of said drive shaft comprises a polygonal-shaped outer surface, a portion of said camming clutch member comprising a polygonal-shaped inner surface, said outer surface portion supporting said inner surface portion in a mating fashion.

8. The driver according to claim 7 where in said outer surface portion of said drive shaft and said inner surface portion of said second camming clutch member being hexagonal-shaped.

9. The driver according to claim 7 wherein said engageable surface of said camming clutch member and said engageable surface of said drive clutch member comprise a serrated surface.

10. The driver according to claim 9 where said serrated surface of said drive clutch member comprises a clock-wise facing serrated surface.

11. The driver according to claim 7 wherein said means for coupling said drive shaft to said second camming clutch member further comprises:

a pin intersecting said drive shaft and said second camming clutch member; and a pair of wheel members located on opposing sides of said pin, said wheel members further securing said pin to said drive shaft and said second camming clutch member.

12. The driver according to claim 11 wherein said wheels are located within a respective slot located in said opposing sides of said camming clutch member, said wheel members providing bearing means for said camming clutch member.

13. The driver according to claim 7 wherein said drive clutch member comprises an outer chamfered surface, said outer chamfered surface abutting an internal chamfered surface of said housing, thereby providing means for delivering torque from said handle to said drive assembly, said torque delivering means being independently arranged from said biasing means.

14. The driver according to claim 13 wherein said outer chamfered surface being angled at 45° with respect to a central axis of said housing, said internal chamfered surface being at a complimentary angle to said outer chamfered surface.

15. A method for assembling a torque-limiting driver, said method comprising the steps of:

providing a handle comprising a housing;

providing a testing assembly having a first open end and a second closed end;

providing a drive assembly comprising:

a drive shaft;

a drive clutch member supported by said drive shaft, said drive clutch member having an engageable surface;

a camming clutch member supported by said drive shaft, said camming clutch having an engageable surface arranged to interact with the engageable surface of said drive clutch member;

means for biasing said first drive clutch member and said second camming clutch member towards one another;

means for locking said drive assembly;

inserting and securing said drive assembly within said testing assembly;

adjusting said locking means for proper tension of said drive assembly;

removing said drive assembly from said testing assembly;

inserting said drive assembly into said housing; and securing said drive assembly to said housing.

16. The method according to claim 15, wherein the step of inserting said drive assembly into said housing comprises inserting said locking means first into said housing.

17. The method according to claim 15 wherein the step of securing said drive assembly within said testing assembly further comprises threading said drive assembly onto said testing assembly.

18. The method according to claim 15 further comprising the step of abutting said drive assembly against said housing when inserting said drive assembly into said housing, said step of abutting thereby providing means for delivering torque from said handle to said drive assembly, said torque delivering means being independently arranged from said biasing means.

* * * * *